US005159802A

United States Patent [19]

Byrd

[11] Patent Number: 5,159,802

[45] Date of Patent: Nov. 3, 1992

[54] REFLECTOR ASSEMBLY FOR REMOVABLE DEPENDING SECUREMENT TO EACH STIRRUP TO PROTECT A RIDER AND HORSE

[76] Inventor: Clayton R. Byrd, 43020 S.E. 134th Pl., North Bend, Wash. 98045

[21] Appl. No.: 690,680

[22] Filed: Apr. 24, 1991

[51] Int. Cl.[5] ..... B68C 3/00

[52] U.S. Cl. ..... 54/46.1; 54/76; 359/516

[58] Field of Search ..... 54/1, 46, 47, 76; 359/516, 518, 520, 521, 533, 543, 549, 550

[56] References Cited

U.S. PATENT DOCUMENTS

| | | | |
|---|---|---|---|
| 927,925 | 7/1909 | Bailey | 54/76 |
| 2,038,699 | 4/1936 | Wood | 359/516 |
| 2,079,053 | 5/1937 | Torbert, Jr. | 359/516 X |
| 2,196,550 | 4/1940 | Feltner | 359/516 |
| 2,482,153 | 9/1949 | Cavin | 54/46 |
| 3,990,664 | 11/1976 | Horvath et al. | 359/550 X |

*Primary Examiner*—Robert P. Swiatek

[57] ABSTRACT

So motorists will move readily and sooner observe a rider on a horse, reflector assemblies are removably and dependingly secured to each stirrup. Whether or not the stirrup is an English one or a Western one, the reflector assemblies are secured so each one presents a red reflector lens facing rearwardly and an orange reflector lens facing forwardly. The motions of the horse and the rider combine to cause overall movements of the reflector lens, enhancing their noticeability by motorists, and thereby protecting the rider and the horse.

7 Claims, 2 Drawing Sheets

FIG. 1
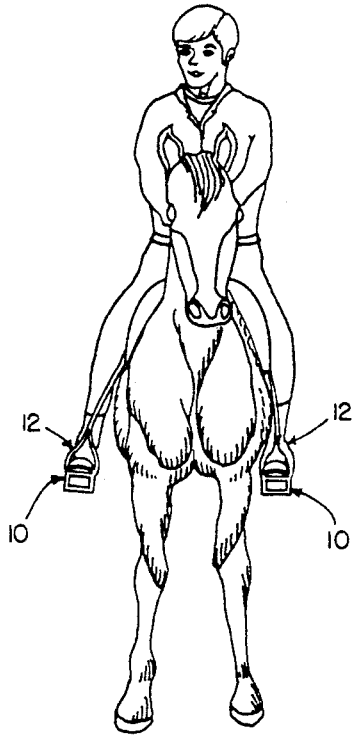
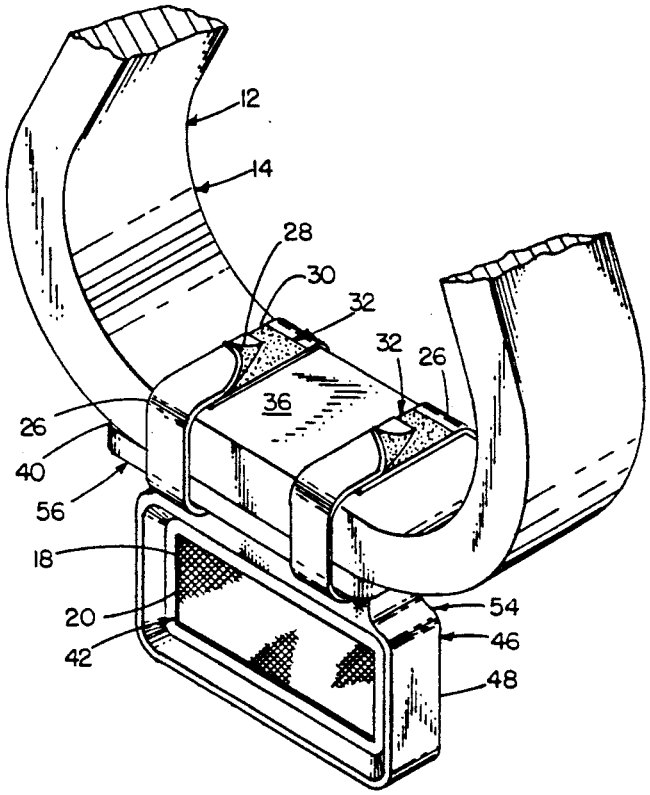
FIG. 2
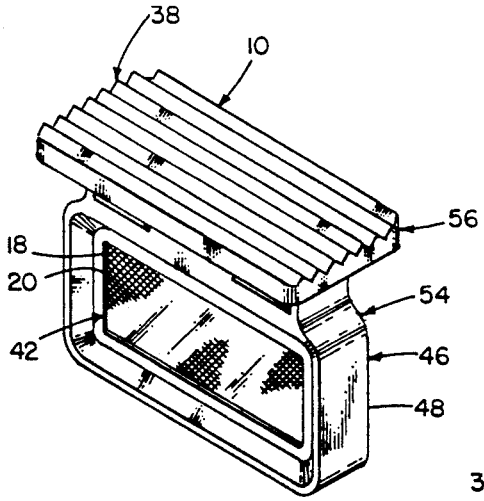
FIG. 3
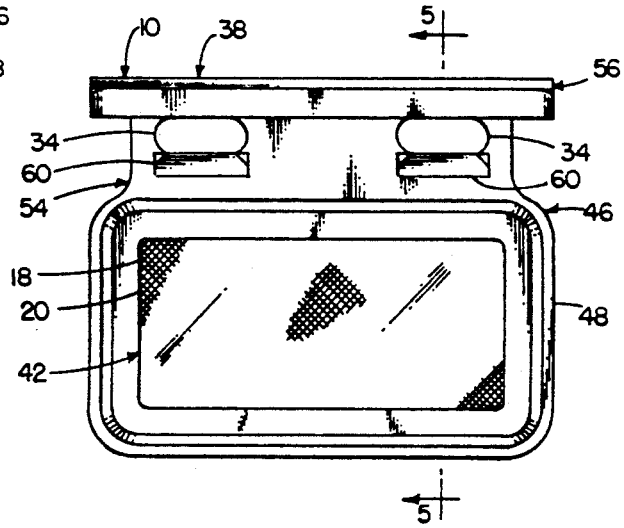
FIG. 4

REFLECTOR ASSEMBLY FOR REMOVABLE DEPENDING SECUREMENT TO EACH STIRRUP TO PROTECT A RIDER AND HORSE

BACKGROUND

When horseback riders ride their horses near, alongside, and/or on roadways, city streets, highways, during twilight, evening, and night times, they try to wear clothing, often inclusive of safety reflective vests, hoping they will be seen soon enough by motorists in approaching vehicles, so they and their horses will not be hit, and/or the motorists will not lose control of their vehicles in trying to avoid them. They may also rely on flashlights. As effective as these precautions are, there is a need to make the motorists of oncoming vehicles more observant of riders and their horses.

SUMMARY

To increase the ability of motorists of oncoming vehicles to observe soon enough riders and their horses, riding where vehicles are being operated, reflector assemblies are removably secured to either English or Western stirrups to depend therefrom, thereby positioning reflector lens below each boot worn by the rider. The motorists in oncoming vehicles, readily observe the resulting motions of these reflector lens caused by the movements of both the rider and his or her horse.

Each reflector assembly has a reflector lens subassembly presenting on one side a red lens reflector to face rearwardly, and an orange or yellow lens reflector to face forwardly. This reflector lens subassembly is removably insertable into an elastomer integral holding and connecting subassembly. This subassembly has a holding frame portion, in turn having a continuous rectangular receiving channel to stretchably receive and to retractably grip and to hold the continuous rectangular edges of the reflector lens subassembly.

Also this elastomer integral holding and connecting subassembly has, above the top of the holding frame portion, a multiple use interconnecting portion, serving to interconnect the reflector assembly to depend from either an English stirrup or a Western stirrup.

In respect to securing the reflector assembly to a Western stirrup, the interconnecting portion has two spaced rectangular openings to receive straps, equipped preferably with loop and hook fasteners, which, after passing through these openings, extend up over and down the boot supporting portion of the Western stirrup, to complete the depending securement of the reflector assembly to the Western stirrup.

In respect to securing the reflector assembly to an English stirrup, the interconnecting portion has an enlarged horizontal planar boot contacting sub-portion. Then spaced below this sub-portion are horizontally projecting tabs creating transverse horizontal receiving channels, located between themselves and the boot contacting sub-portion, to grip transverse horizontal spaced portions of the boot receiving portion of the English stirrup. These transverse horizontal spaced portions are integrally formed with other metal portions of the English stirrup creating a central slotted opening.

To secure the reflector assembly to the English stirrup, the reflector lens subassembly is removed. Thereafter, the holding frame portion is compressively distorted and then passed down through the central slotted opening between the transverse horizontal spaced portions of the boot receiving portion of the English stirrup. Thereafter the enlarged horizontal planar boot contacting sub-portion rests on the metal portions of the English stirrup presenting a convex curved transverse ribbed surface structure to be contacted by the sole of a boot. Then the reflector lens subassembly is inserted back into the holding frame portion. This installed portion of the reflector assembly is firmly maintained by the cooperative holding functions of the boot contacting sub-portion with the horizontally projecting tabs, the resiliency of the elastomer materials used in making this reflector assembly, and the replaced reflector lens subassembly.

DRAWINGS

The reflector assembly for removable depending securement to each stirrup to protect a rider and his or her horse, is illustrated in the drawings, wherein:

FIG. 1 is a front view of a person mounted on a horse indicating the location of each reflector assembly in respect to each stirrup;

FIG. 2 is a partial perspective view of a Western stirrup showing how straps are used to secure the reflector assembly to boot receiving portions of a Western stirrup;

FIG. 3 is a perspective view of the reflector assembly;

FIG. 4 is a front view of the reflector assembly, presenting an orange or yellow reflector lens, and the back view would be similar, presenting, however, a red reflector lens to be observed by a motorist of an oncoming vehicle;

Figure 6:
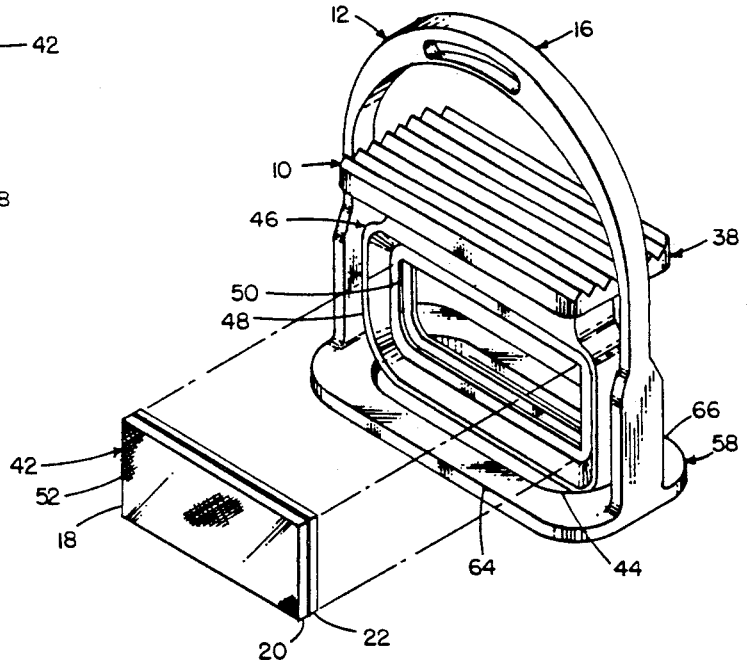
Figure 7:
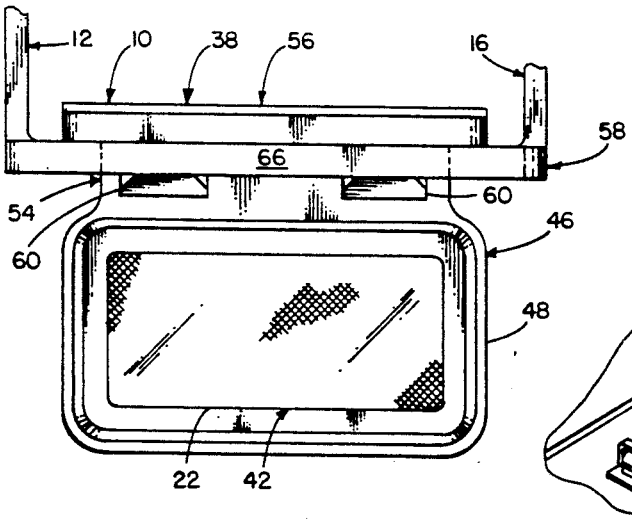
Figure 8:
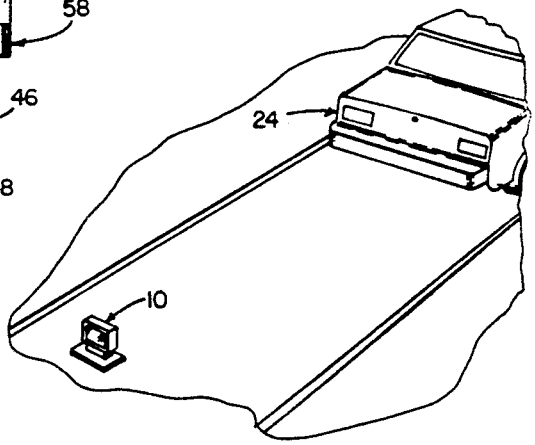

FIG. 6 is a perspective view illustrating how the reflector lens subassembly is removed, before the reflector assembly has the holding frame portion of the elastomer integral holding and connecting subassembly thereof, distorted sufficiently to pass this holding frame portion down through the central slotted opening between the transverse horizontal spaced portions of the boot receiving portion of the English stirrup;

FIG. 7 is a partial rear view, showing how the reflector assembly has been installed on the English stirrup, shown only partially, after the reflector lens subassembly has been inserted back into the holding frame portion of the elastomer integral holding and connecting subassembly, and the transverse horizontal spaced portions of the boot receiving portion of the English stirrup are then gripped in the transverse horizontal receiving channels formed between the boot contacting sub-portion and the horizontally projecting tabs of the reflector assembly, the partial front view being the same; and FIG. 8 is a partial perspective view, illustrating how the reflector lens subassembly is used, independently, for placement at a distance from a stalled vehicle, serving again to warn motorists of oncoming vehicles about what is occurring ahead of them that they should avoid.

DESCRIPTION OF THE PREFERRED EMBODIMENT

A preferred embodiment of the reflector assembly 10 is illustrated throughout the figures of the drawings.

Each reflector assembly 10 is manufactured to be installed to depend in part below each stirrup 12, whether it be a Western stirrup 14, or an English stirrup 16, as illustrated in FIG. 1, when a rider is mounted on his or her horse. Each reflector assembly 10, presents a reflective lens assembly 18, either an amber, yellow, or orange reflective lens 20, facing toward the front, or a red reflective lens 22, facing toward the rear, for observation by motorists of oncoming vehicles 24.

In respect to Western stirrups 14, as shown in FIG. 2, two straps 26, each having loop 28 and hook 30 fasteners 32, are passed through two spaced rectangular openings 34 of the reflector assembly 10. Then they are moved up and around the boot supporting portion 36 of the Eastern stirrup 14. Thereafter they are secured, as shown in FIG. 2. FIG. 3, illustrates the convex curved transverse ribbed surface structure 38 of the reflector assembly 10, which is held in contact with the underside 40 of the boot supporting portion 36 of the Western stirrup 14. The locations of the two spaced rectangular openings 34 of the reflector assembly 10 are illustrated in FIG. 4.

In respect to English stirrups 16, as shown in FIGS. 6 and 7, the reflector assembly 10 is interfitted with each English stirrup 16. As illustrated in FIG. 6, the reflector lens subassembly 42, incorporating an amber, yellow or orange reflective lens 20, and a red reflective lens 22, is first removed from the reflector assembly 10. Then portions of this reflector assembly 10 are distorted upon squeezing them together, so portions of this reflector assembly 10 are passed downwardly through a central slotted opening 44 in the English stirrup 16. Thereafter the reflector lens subassembly 42 is reinstalled.

Figure 5:
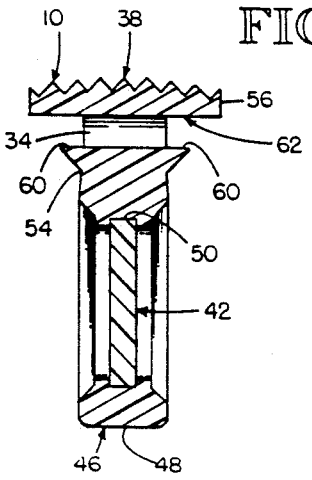
FIG. 5 is a cross sectional view taken on line 5—5 of FIG. 4 to show the inserted placement of the reflector lens subassembly, the horizontally projecting tabs creating transverse horizontal receiving channels between themselves and the enlarged horizontal planar boot contacting sub-portion of the interconnecting portion of the reflector assembly.

As shown in FIGS. 5 and 6, the reflector lens subassembly 42 is removably insertable into an elastomer integral holding and connecting subassembly 46. This subassembly 46 has a holding frame portion 48, in turn having a continuous rectangular receiving channel 50, to stretchably receive and to retractably grip and to hold the continuous rectangular edges 52 of the reflector lens subassembly 42.

Also this elastomer integral holding and connecting subassembly 46 has, above the top of the holding frame portion 48, a multiple use interconnecting portion 54, serving to interconnect the reflector assembly 10 to depend from either an English stirrup 16 or a Western stirrup 14. This multiple use interconnecting portion 54 has an enlarged horizontal planar boot contacting subportion 56 which bears down against the boot supporting portion 58 of an English stirrup 16, as shown in FIG. 7. Also it has the convex curved transverse ribbed surface structure 38 to be contacted by the sole of a boot inserted into an English stirrup 16 equipped with this reflector assembly 10. The two spaced rectangular openings 34 are located in this multiple use interconnecting portion 54 to receive the straps 26.

As illustrated in FIGS. 4, 5, and 7, there are horizontally projecting tabs 60 which create transverse horizontal receiving channels 62, located between themselves and the boot contacting sub-portion 56, to grip transverse horizontal spaced portions 64, 66 of the boot receiving portion 58 of the English stirrup 16. These transverse horizontal spaced portions 64, 66, are integrally formed with other metal portions of the English stirrup 16 creating the central slotted opening 44.

This reflector assembly 10, utilizing the resilient and memory properties of an elastomer material, such as the rubber like product sold under the trademark "Santoprene", is molded into a design, which is optionally fitted to either a Western stirrup 14 or an English stirrup 16, and to receive a standard reflector lens subassembly 42.

When this reflector assembly 10 is secured to the stirrups 12, the horse and rider will be more readily observed by the motorist of an oncoming vehicle. Moreover, when the horse and rider are moving, their combined movements cause the reflector assemblies 10 to move about increasing the opportunities of being timely observed by the motorist of an oncoming vehicle.

As illustrated in FIG. 8, the reflector assemblies 10, have an independent reflector use, for example, when a vehicle is disabled by a flat tire or other problem. These reflector assemblies 10 are then placed away from the disabled vehicle to warn oncoming motorists driving vehicles approaching the location of the disabled vehicle.

I claim:

1. A reflector assembly for securement to a stirrup to protect a rider and a horse;

which is removably secured to a stirrup to depend therefrom;

which has an elastomer integral holding and connecting subassembly: having portions thereof which temporarily are distorted enough to be interfitted with an English stirrup; having portions thereof which are a holding frame portion, inclusive of a rectangular receiving channel; and having an enlarged horizontal planar boot contacting sub-portion; and which has a reflector lens subassembly having continuous rectangular edges fitted into the rectangular receiving channel of the holding frame portion.

2. A reflector assembly, as claimed in claim 1, wherein the elastomer integral holding and connecting subassembly has horizontal projecting tabs spaced below the enlarged horizontal planar boot contacting sub-portion to create transverse horizontal receiving channels adapted to receive horizontal spaced portions of a boot supporting portion of an English stirrup.

3. A reflector assembly, as claimed in claim 2, wherein the elastomer integral holding and connecting subassembly has openings to receive straps used in securing this reflector assembly to a Western stirrup.

4. A reflector assembly, as claimed in claim 3, having straps to pass through the openings of the elastomer integral holding and connecting subassembly, and thereafter to be secured around a boot supporting portion of a Western stirrup.

5. A reflector assembly, as claimed in claim 4, wherein the straps have loop and hook fasteners used to secure the straps in place, to in turn secure the reflector assembly to a Western stirrup.

6. A reflector assembly, as claimed in claim 3, wherein the elastomer integral holding and connecting subassembly has a multiple use interconnecting portion, serving to position the enlarged horizontal planar boot contacting sub-portion, the horizontal projecting tabs, the openings, the transverse horizontal receiving channels, and the holding frame portion, all being portions of the elastomer integral holding and connecting subassembly.

7. A reflector assembly, as claimed in claim 6, which has a reflector lens subassembly having a red reflector lens to face to the rear and an amber, orange, or yellow reflector lens to face to the front.

* * * * *